United States Patent [19]

Mills

[11] Patent Number: 5,016,582

[45] Date of Patent: May 21, 1991

[54] ROCKER ARM

[75] Inventor: Jesse V. Mills, Toledo, Ohio

[73] Assignee: Henley Manufacturing Holding Company, Inc., Hampton, N.H.

[21] Appl. No.: 596,359

[22] Filed: Oct. 12, 1990

[51] Int. Cl.[5] ..... F01L 1/18

[52] U.S. Cl. ..... 123/90.39; 123/90.41; 123/90.44; 74/519; 74/559

[58] Field of Search ..... 123/90.39, 90.4, 90.41, 123/90.42, 90.44, 90.47; 74/519, 559

[56] References Cited

U.S. PATENT DOCUMENTS

| | | | |
|---|---|---|---|
| 4,614,171 | 9/1986 | Malhotra | 123/90.39 |
| 4,628,874 | 12/1986 | Barlow | 123/90.39 |
| 4,697,473 | 10/1987 | Patel | 123/90.9 |
| 4,796,483 | 1/1989 | Patel et al. | 123/90.39 |
| 4,825,717 | 5/1989 | Mills | 123/90.39 |
| 4,829,647 | 5/1989 | Anderson et al. | 123/90.39 |
| 4,913,104 | 4/1990 | Mills | 123/90.4 |

*Primary Examiner*—David A. Okonsky
*Assistant Examiner*—Weilun Lo
*Attorney, Agent, or Firm*—Allen D. Gutchess, Jr.

[57] ABSTRACT

A one-piece, cold-formed rocker arm of the cam-follower type includes a one-piece metal body which is cold-formed from a metal blank and is of U-shaped cross section at first and second end portions. The first end of said body has a bottom wall and two upwardly-extending side walls with a rounded recess in the bottom wall having a concave side facing downwardly for receiving an end of a lifter post on which the rocker arm can pivot. The second end of the body has a groove formed by a bottom wall with two downwardly-extending side walls and two doubled-back, upwardly-extending side walls which are structurally integral at lower edges with lower edges of the downwardly-extending side walls. The groove of the second end portion faces downwardly to receive an upper end of a valve stem. An intermediate portion of the body has two substantially parallel side walls which are structurally integral with the upwardly-extending side walls of the first and second end portions. The intermediate portion of the body is open between the parallel side walls and between the bottom walls of the first and second portions. The parallel side walls carry an axle on which a roller is rotatably mounted for engaging an overhead cam.

18 Claims, 2 Drawing Sheets

ROCKER ARM

This invention relates to a rocker arm of the cam-follower type.

A rocker arm in accordance with the invention is of the cam-follower type and is made by cold-forming operations, including stamping, coining, staking, and back-packing. The rocker arm includes a one-piece metal body having first and second end portions and an intermediate portion. The first end portion of the body has a bottom wall with two structurally-integral side walls extending upwardly therefrom. The bottom wall has a rounded recess facing downwardly to receive an upper end of a lifter post on which the rocker arm can pivot. The second end portion of the rocker arm body forms a groove of inverted, generally square U-shaped cross section to receive an end of a valve stem. The second end portion has a bottom wall with two structurally-integral, downwardly-extending side walls and two outer, upwardly-extending side walls which are structurally integral with lower edges of the downwardly-extending side walls and extend upwardly in substantially contiguous relationship therewith. The intermediate portion of the body has two substantially parallel side walls which are structurally-integral with the upwardly-extending side walls of both the first and second end portions of the body. The parallel side walls have axially-aligned openings carrying an axle on which a roller is rotatably mounted. A circumferential portion of the roller projects upwardly beyond edges of the parallel side walls for engaging an overhead cam. The intermediate portion of the body is substantially open between the parallel side walls and between the bottom walls of the first and second end portions of the body.

The particular design of the rocker arm with the bottom walls forming the rounded recess and the square-shaped groove enables the rocker arm to be shorter than rocker arms which have the recess and groove formed in upper, top walls of the body. With the rounded recess in the bottom wall, the side walls can have a greater clearance with a lifter post cylinder and the engine block. The rocker arm can also be narrower at that end since the greater clearance is achieved at the lower edges of the side walls and the side walls do not have to be wider to extend around the cylinder. These side walls can also extend upwardly to a greater extent for more stiffness. The doubled-back design of the side walls at the second end portion of the body also enables the groove to be deeper and adds to the stiffness of the body to reduce the tendency for the rocker arm to flex, albeit minutely, during operation.

It is, therefore, a principal object of the invention to provide a rocker arm in which a groove and recess for receiving a valve stem and lifter post are formed in a bottom wall of the rocker arm body.

Another object of the invention is to provide a rocker arm of the cam-follower type which can be shorter than conventional rocker arms.

A further object of the invention is to provide a rocker arm of the cam-follower type having an end portion with doubled-back side walls forming a downwardly-facing groove to receive an end of a valve stem.

Many other objects and advantages of the invention will be apparent from the following detailed description of a preferred embodiment thereof, reference being made to the accompanying drawings, in which.

Figure 1:
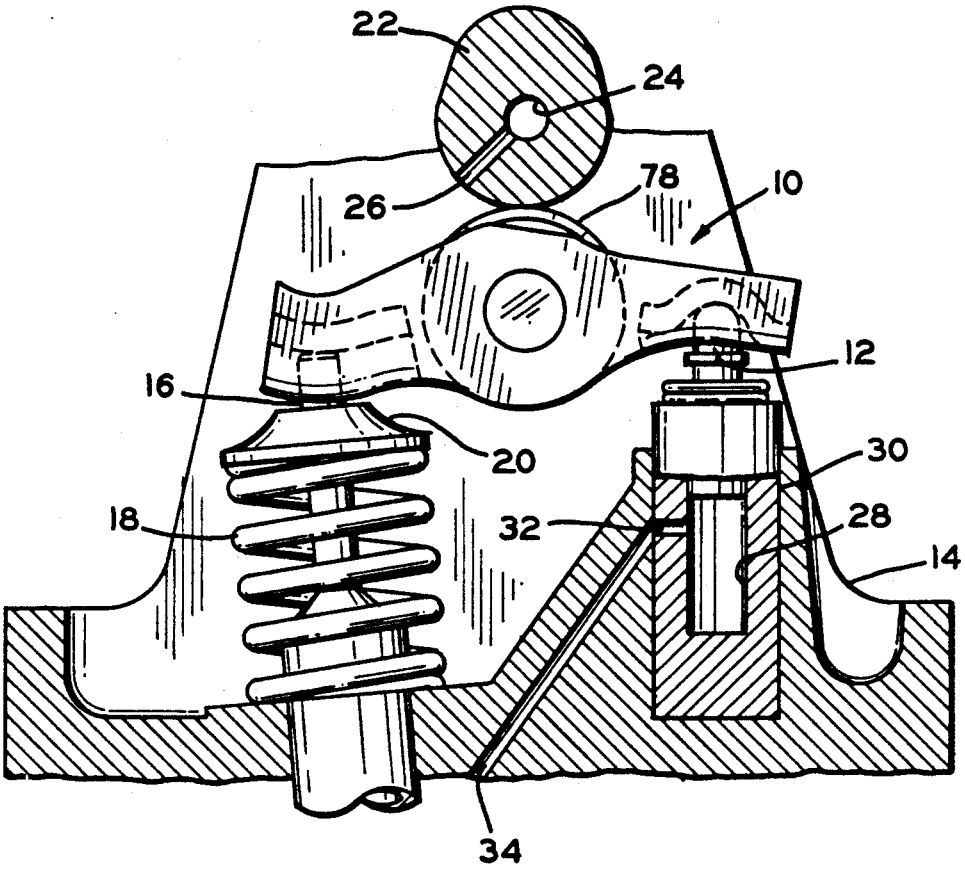
FIG. 1 is somewhat schematic view in cross section, with parts in elevation, of valve-actuating mechanism including a rocker arm in accordance with the invention.
Figure 2:
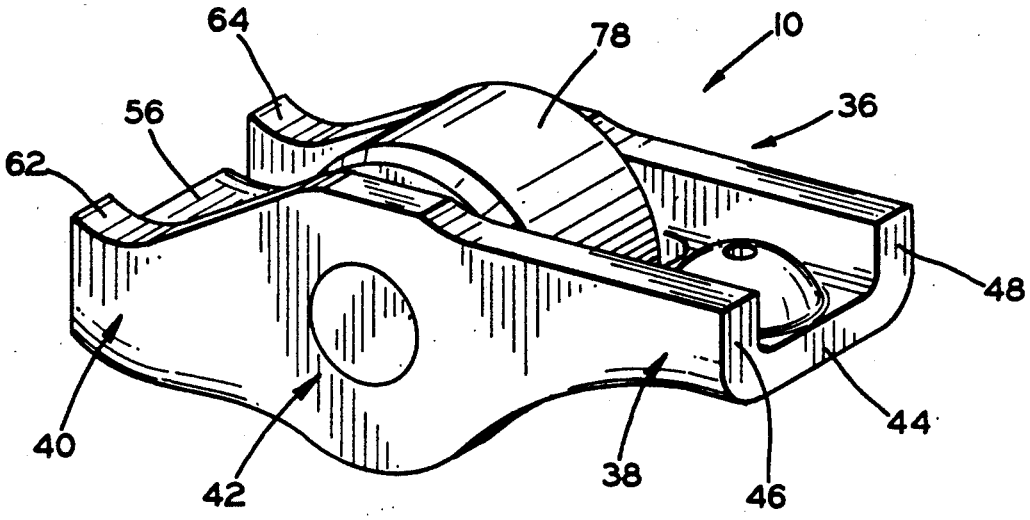
FIG. 2 is an enlarged view in perspective of the rocker arm of FIG. 1.
Figure 3:
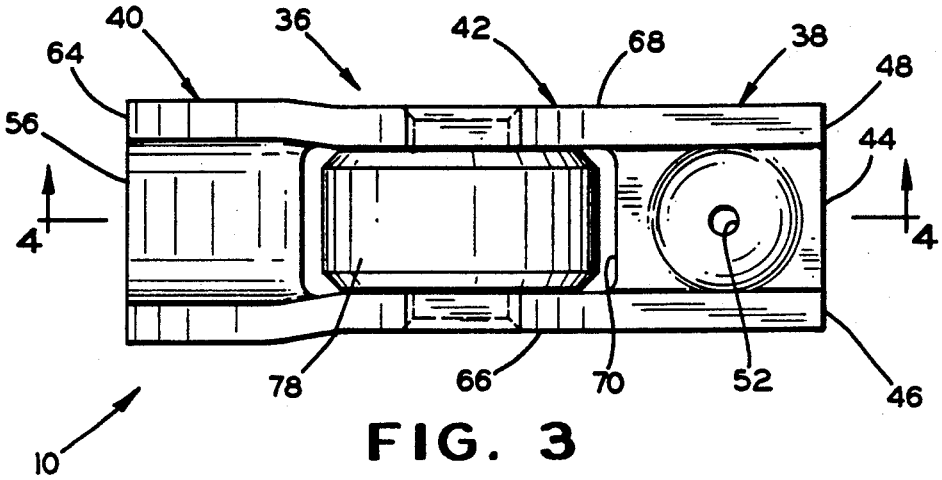
FIG. 3 is a top view of the rocker arm of FIG. 2.
Figure 4:
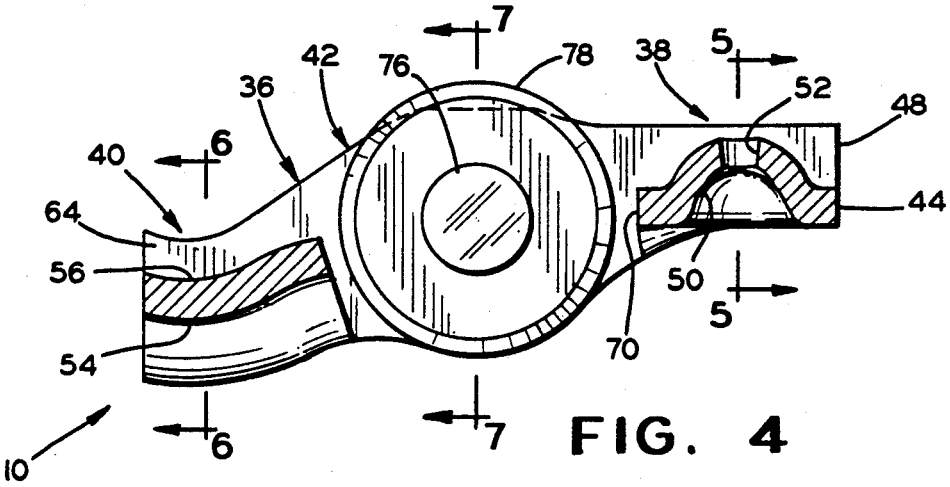
FIG. 4 is a view in longitudinal cross section taken along the line 4—4 of FIG. 3.
Figure 5:
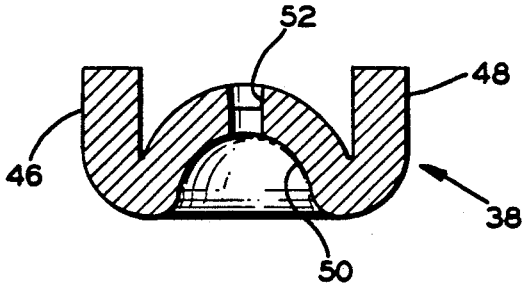
FIG. 5 is a view in transverse cross section taken along the line 5—5 of FIG. 4.
Figure 7:
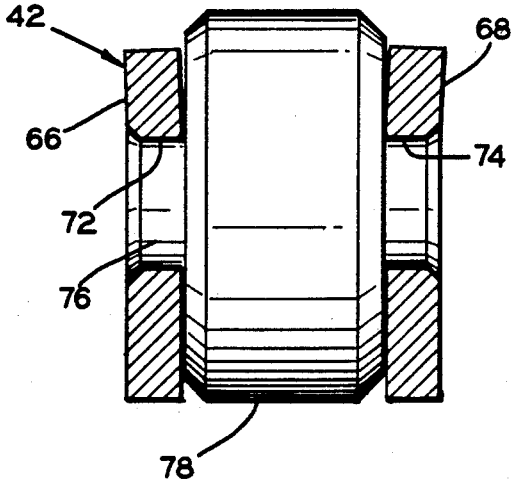
FIG. 7 is a view in transverse cross section taken along the line 7—7 of FIG. 4.

Referring particularly to FIG. 1, a rocker arm of the cam-follower type is indicated at 10 and has a first end portion received on a rocker arm fulcrum or lifter post 12 extending upwardly from a cylinder head 14 of an internal combustion engine. A second end portion of the rocker arm engages an upper end of a valve stem 16. The valve stem extends upwardly from the cylinder head 14 through a coiled compression spring 18 located therearound and which is seated against the cylinder head and against a retainer ring 20 mounted on the stem 16. An overhead cam 22 engages an intermediate portion of the rocker arm 10 to cause a valve (not shown) located at the lower end of the valve stem 16 to open and close as the stem is moved longitudinally by the rocker arm 10. Oil or other lubricating fluid can be supplied through a central passage 24 in the cam shaft of the cam 22 and to a transverse passage 26.

The lifter post or fulcrum 12 is slidably carried in a chamber 28 of a cylinder 30. The post 12 is urged upwardly by fluid, such as oil under pressure, in the chamber 28 which is supplied through a small port 32 from a supply passage 34. The post 12 can thereby yield somewhat when the cam 22 rotates. In practice, the post 12 moves downwardly slightly at the high lobe of the cam 22 to provide a zero lash adjustment for the rocker arm 10. The port 32 is of a size to provide for controlled leakage of the oil from the chamber 28 to control pressure of the oil therein. Oil can also be supplied from the passage 34 through a passage in the lifter post 12 and up to the rocker arm 10 for lubricating purposes.

Referring more particularly to FIGS. 2–7, the rocker arm 10 includes a one-piece, cold-formed metal body 36 which is preferably made by cold-forming operations, including stamping, coining, staking, and back-packing. The rocker arm body 36 includes a first end portion 38, a second end portion 40 and an intermediate portion 42.

The first end portion 38 of the rocker arm body 36 has a lower or bottom wall 44 (FIGS. 2, 3, and 4) and two upwardly-extending side walls 46 and 48. These are structurally integral with the bottom wall 44 at their lower edges and extend upwardly in substantially parallel relationship. The side walls add significant stiffness to the overall rocker arm body 36. A rounded recess 50 is formed in the bottom wall 44 and faces downwardly, away from the side walls 46 and 48. The recess 50 receives the upper end of the lifter post 12 on which the rocker arm 10 can pivot. A lubricating or oil opening 52 formed through the bottom wall 44 of the first end portion 38 communicates with the recess 50 and can provide a reservoir for oil which can be collected therein and supplied to the mating surfaces of the recess 50 and the lifter post 12.

Figure 6:
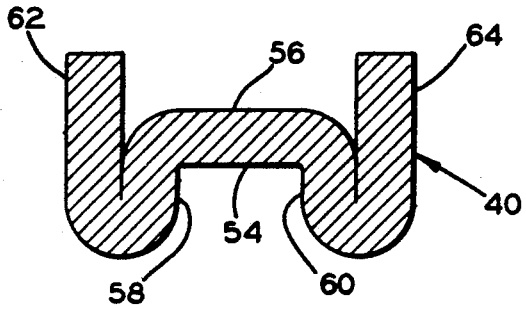
FIG. 6 is a view in transverse cross section taken along the line 6—6 of FIG. 4.

The second end portion 40 of the rocker arm body 36 has an elongate recess or groove 54 (FIGS. 4 and 6) which is of inverted, generally square U-shaped configuration in transverse cross section. The groove 54 receives the upper end of the valve stem 16 and moves the stem longitudinally when the rocker arm 10 pivots. The second end portion 40 has a lower or bottom wall 56 with two downwardly-extending side walls 58 and 60 which form the groove 54. The upper edges of the side walls 58 and 60 are structurally integral with side edges of the bottom wall 56. The second end portion 40 also has upwardly-extending, outer side walls 62 and 64 which are doubled back from the side walls 58 and 60, being structurally-integral at lower edges with the lower edges of the side walls 58 and 60. As shown, the upwardly-extending side walls 62 and 64 are longer than the downwardly-extending side walls 58 and 60 and extend upwardly above the bottom wall 56 of the second portion 40 for added stiffness, but this is not essential. The double walls 58–64 enable the groove 54 to be deeper and also contribute to the stiffness of the rocker arm body 36. For compactness, portions of the side walls 58, 62 and 60, 64 are contiguous, as shown in FIG. 6.

The intermediate portion 42 of the rocker arm body 36 has two substantially parallel side walls 66 and 68 (FIGS. 3 and 7) which are structurally integral with and form continuations of the side walls 46 and 48 of the first portion 38 and the outer side walls 62 and 64 of the second portion 40 of the rocker arm body 36. The intermediate portion 42 of the rocker arm body also has a large generally rectangular opening 70 (FIGS. 3 and 4) formed by the parallel side walls 66 and 68 and inner edges of the bottom wall 44 and the bottom wall 56 of the first and second portions 38 and 40. The parallel side walls 66 and 68 have axially-aligned openings 72 and 74 which carry an axle 76. Ends of the axle 76 can be turned outwardly to prevent longitudinal movement of the axle 76 in the openings. A cam-contacting roller 78 is rotatably mounted on the axle 76, preferably with a bearing (not shown) therebetween. The roller 78 is located in the opening 70 and can have a circumferential portion extending above the side walls 66 and 68. The roller 78 is positioned to contact the cam 22 so as to cause pivotal movement of the rocker arm 10 about the lifter post 12 as the cam 22 rotates. This causes the aforementioned axial movement of the valve stem 16 and the opening and closing of the valve at the lower end thereof.

Heretofore, recesses in rocker arms for the lifter post and valve stem have been formed in an upper wall of the rocker arm body, as shown in U.S. Pat. No. 4,697,473, issued Oct. 6, 1987, for example. However, it has been found that when the recess 50 and the elongate recess or groove 54 are formed in the lower or bottom walls 44 and 56 of the rocker arm body 36, the rocker arm can be made in smaller sizes and shorter than those heretofore known. This is achieved, in part at least, by the fact that the lower walls 44 and 56 can be shorter and terminate near the cam-contacting roller 78, forming the rectangular opening 70. This is particularly advantageous for smaller internal combustion engines and for those employing multiple valves for each cylinder. With the recess in the bottom wall, the side walls can have a greater clearance with the lifter post cylinder and the engine block. The rocker arm can also be narrower at the first end portion 38 since less distance is needed between the side walls 46 and 48 to clear the cylinder and block. The side walls can also extend upwardly farther for greater stiffness at the first end portion of the rocker arm body. The doubled-back side walls enable the groove 54 to be deeper and the arm stiffer.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A one-piece, cold-formed, rocker arm of the cam-follower type comprising a one-piece metal body having a first end portion, a second end portion, and an intermediate portion between said first and second end portions, said first end portion of said body having a first bottom wall and two first upwardly-extending, structurally-integral side walls, said bottom wall and said side walls forming an upright, generally square U-shaped configuration in transverse cross section, said bottom wall having a rounded recess with a concave side facing away from said side walls for receiving an end of a lifter post on which said rocker arm can pivot, said second end portion of said body having a second bottom wall, two downwardly-extending side walls structurally-integral therewith, and two doubled-back, second upwardly-extending side walls which are structurally integral at lower edges with lower edges of said downwardly-extending side walls, said second bottom wall and said downwardly-extending side walls forming a groove having an inverted, generally square U-shaped configuration in transverse cross section for receiving an upper end of a valve stem, said intermediate portion of said body having two substantially parallel side walls structurally integral with the upwardly-extending side walls of said first and second end portions, said parallel side walls having axially-aligned openings therein, an axle extending through said aligned openings and affixed to said parallel side walls for prevention of longitudinal movement of said axle, and a roller rotatably mounted around said axle and being positioned to engage an overhead cam.

2. A rocker arm according to claim 1 wherein portions of said downwardly-extending side walls and said second upwardly-extending side walls are substantially contiguous.

3. A rocker arm according to claim 1 wherein said roller has a circumferential portion projecting upwardly above edges of said parallel side walls for engaging the overhead cam.

4. A rocker arm according to claim 1 wherein said second upwardly-extending side walls extend upwardly above said second bottom wall.

5. A rocker arm according to claim 1 wherein said intermediate portion of said body has a generally rectangular opening formed between said substantially parallel side walls and ends of said bottom walls of said first and second portions.

6. A one-piece, cold-formed, rocker arm of the cam-follower type comprising a one-piece metal body having a first end portion, a second end portion, and an intermediate portion between said first and second end portions, said first end portion of said body having a first bottom wall and first upwardly-extending side walls which are structurally-integral with said bottom wall, said bottom wall and said side walls forming an upright, generally square U-shaped configuration in transverse cross section, said bottom wall having a rounded recess with a concave side facing away from said side walls for receiving an end of a lifter post on which said rocker arm can pivot, said second end portion of said body having a second bottom wall and side walls structurally-integral therewith, said second bottom wall and said side walls of said second portion forming a groove having an inverted, generally square U-shaped configuration in transverse cross section for receiving an upper end of a valve stem, said side walls of said second end portion comprising two downwardly-extending side walls which are structurally-integral with side edges of said second bottom wall and two doubled-back, second upwardly-extending side walls which are structurally-integral with lower edges of said downwardly-extending side walls, said second upwardly extending side walls being substantially contiguous with said downwardly-extending side walls, said intermediate portion of said body having two substantially parallel side walls, said intermediate portion of said body having a large, generally rectangular opening formed by said substantially parallel side walls and by inner ends of said bottom walls of said first and second portions, an axle carried by said parallel side walls, and a roller rotatably mounted around said axle and having a circumferential portion positioned to engage an overhead cam.

7. A rocker arm according to claim 6 wherein said second upwardly-extending side walls extend upwardly above said second bottom wall.

8. A rocker arm according to claim 6 wherein said substantially parallel side walls are structurally integral with said first upwardly-extending side walls and said second upwardly-extending walls.

9. A one-piece, cold-formed rocker arm of the cam-follower type comprising a one-piece metal body having a first end portion, a second end portion, and an intermediate portion between said first and second end portion, said first end portion of said body having means for receiving an end of a lifter post on which said rocker arm can pivot, said second end portion of said body having a bottom wall, two downwardly-extending side walls structurally integral therewith, and two doubled-back, upwardly-extending side walls which are structurally integral at lower edges with lower edges of said downwardly-extending side walls, said bottom wall and said downwardly-extending side walls forming a downwardly-facing groove for receiving an upper end of a valve stem, said intermediate portion of said body having two substantially parallel side walls, an axle carried by said parallel side walls, and a roller rotatably mounted on said axle and positioned to engage an overhead cam.

10. A rocker arm according to claim 9 wherein portions of said downwardly-extending side walls and said upwardly-extending side walls are substantially contiguous.

11. A rocker arm according to claim 9 wherein said substantially parallel side walls are structurally integral with the upwardly-extending side walls of said second end portion.

12. A rocker arm according to claim 9 wherein said groove is of inverted, generally square U-shaped configuration in transverse cross section.

13. A rocker arm according to claim 9 wherein said first portion of said body has a bottom wall and two upwardly-extending, structurally-integral side walls, said bottom wall of said first portion having a rounded recess with a concave side facing away from said first portion side walls for receiving the end of the lifter post.

14. A rocker arm according to claim 13 wherein said first end portion has an opening extending through said bottom wall of said first end portion and communicating with said rounded recess to form an oil passage.

15. A rocker arm according to claim 13 wherein said parallel side walls of said intermediate portion are structurally integral with the upwardly-extending side walls of said first and second end portions.

16. A rocker arm according to claim 13 wherein said body has an opening between said substantially parallel side walls and between the bottom walls of said first and second portions.

17. A rocker arm according to claim 9 wherein said roller has a circumferential portion projecting outwardly beyond edges of said parallel side walls.

18. A rocker arm according to claim 9 wherein said upwardly-extending side walls extend upwardly above said bottom wall.

* * * * *